US005278909A

United States Patent [19]

Edgar

[11] Patent Number: 5,278,909

[45] Date of Patent: Jan. 11, 1994

[54] SYSTEM AND METHOD FOR STEREO DIGITAL AUDIO COMPRESSION WITH CO-CHANNEL STEERING

[75] Inventor: Albert D. Edgar, Austin, Tex.

[73] Assignee: International Business Machines Corporation, Armonk, N.Y.

[21] Appl. No.: 894,981

[22] Filed: Jun. 8, 1992

[51] Int. Cl.[5] ..... H04S 5/00

[52] U.S. Cl. ..... 381/17; 381/22; 381/23; 381/18; 381/1

[58] Field of Search ..... 381/2, 17, 21, 22, 23, 381/18, 1

[56] References Cited

U.S. PATENT DOCUMENTS 3,789,144 1/1974 Doyle .
4,485,483 11/1984 Torick et al. .
4,486,076 12/1984 Taenzer .
4,680,796 7/1987 Blackmer et al. .
4,769,841 9/1988 Cugnini .
4,815,132 3/1989 Minami ..... 381/1
4,825,305 4/1989 Itoh et al. .

FOREIGN PATENT DOCUMENTS 871992 7/1961 United Kingdom ..... 381/2

*Primary Examiner*—Jin F. Ng
*Assistant Examiner*—Mark D. Kelly
*Attorney, Agent, or Firm*—Robert M. Carwell

[57] ABSTRACT

Left right and surround components of a stereo signal are coded into a monaural and small co-channel providing volume steering for recreating a stereo effect with a substantially reduced bit rate. The signal is split into a sum and difference signal, the difference signal is randomized and the sum is added to the randomized difference to comprise the single audio channel. A functional relationship is solved for left and right volumes which is then transmitted for intervals on the co-channel. Decoding of the single transmission channel directs it to left, right, or surround channels based on decoding on the logic co-channel. The co-channel updates left and right volume levels which are interpolated through time to effect smooth volume change. Surround gain is determined from left and right channel gains to maintain unity total volume, with the sum of the squares of the three volume controls being unity.

25 Claims, 9 Drawing Sheets

SYSTEM AND METHOD FOR STEREO DIGITAL AUDIO COMPRESSION WITH CO-CHANNEL STEERING

FIELD OF THE INVENTION

This invention relates to compression of stereo digital audio information and in particular to applications requiring high degrees of data compression.

BACKGROUND OF THE INVENTION

Digital audio compression has been a very active field for research and commercial applications, and consequently improvements have recently evidenced diminishing returns. Such work, however, has primarily focused on compressing monophonic signals. Stereo signals, on the other hand, comprise two monophonic signals. The assumption has persisted that twice the bit rate of the single compressed monophonic channel was required for stereo. The connection had simply not been made that two signals of stereo informational content are not only strongly related, but that much of the difference between the two channels is of little consequence to the ear.

Referring to FIGS. 1 and 2, in FIG. 1 a conventional stereo field 1 is depicted, typically generated by a left and right channel, 10, 12 as perceived by the observer 14. As shown in FIG. 2, often these two stereo channels, 10, 12 are electronically split into a sum channel 16 and a difference channel 18 by either adding the two (shown functionally by adder 20) or subtracting the two signals (functionally shown by subtracter 22), the former being the monophonic component, and the latter being the pure stereo difference component which is 0 for a monophonic signal. Averaged across many types of music, the difference signal 18 was found empirically to typically be 3 dB lower than the sum signal 16 at most frequencies, and has further been found to contain very little deep bass because of the nature of acoustic stereo pickup 5.

Still referring to FIG. 2, at the receiving end a similar sum and difference function 24, 26, respectively, was provided to either sum or take the difference between the monophonic sum signal 16 and stereo difference signal 18, the outputs of which resulted in the desired left and right channels again, 28, 30, (corresponding to channels 10, 12 of FIG. 1 respectively). Typically vinyl records, FM broadcasts, and stereo TV all encoded a sum and difference signal in the manner just described. In part this was for purposes of compatibility, but it was also found that lower magnitude and reduction in bass of the difference signal better matches the "weaker" channel which is vertical motion or the 38 KHz signals in a record or FM broadcast, respectively.

In yet another attempt to efficiently encode stereo source information, a technique was developed and referred to in the art as Carver FM noise reduction as shown in FIG. 3. It was found in the course of research on frequency modulated signals that in FM reception the difference signal was characteristically far noisier than the sum signal. Accordingly, some manufacturers began selling FM tuners in which a difference signal was synthesized from the sum signal by a random phasing technique employed in stereo synthesizers. In such a signal the FM receiver 32 provided for a sum and difference channel 34, 36 in the conventional manner. However, additionally, a synthesizer circuit 38 was provided which synthesized the difference signal at appropriate times, e.g. during quiet passages wherein the noise of the "true" difference signal 36 was most noticeable. A switch 35 was provided for switching between the true difference signal 36 and the synthesized signal 42 out of the synthesizer 38, after which the sum signal 34 and switched difference signal 35 were added and subtracted in the conventional manner by the adder and subtracter functions 44, 46 respectively, yielding the desired left and right channels 48, 50. In this technique some separation information was lost in order to effect the desired benefit of reduced noise. However, it was found that due to psychoacoustic phenomenon associated with the listener, the artificial stereo ambiance was accepted without a perceived loss of quality.

There are several aural characteristics of airwaves which are not reproduced with stereo signals unless recorded and reproduced in binaural fashion. In like fashion there are several aural characteristics in a stereo signal not present in monophonic signals, a few of which have been found to be most important for reproducing the stereo experience as reproduced with two speakers.

The most important dimension added by stereo over monophonic sound is the distinction between a "center" signal 15 that is equally phased between the two speaker sources 10 and 12 of FIG. 1, and a "surround" signal 52 which is randomly phased between the two speaker sources. It is this interplay between the center and surround signals when switching from mono to stereo which provides the ambiance causing the perception of such stereo sound as being beautiful and dimensional.

Yet a second most important dimension added by stereo is the left-right separation which, although receiving much attention, has actually been found to be less important than the "surround" aspect. Unlike earlier stereo recordings, modern recordings utilize the left-right separation more in moderation, reserving the full impact only for special effects and concentrating instead on utilizing the center-surround aspect. Although there are other dimensions of a stereo signal, they are not readily discernible on a small stereo system such as a television with two speakers. There are also aspects of binaural sound, such as up-down or front-back which are typically not discernible with two speaker stereo systems.

The perception of surround sound, FIG. 1, has been utilized in movie theaters recently and in homes when viewing movies to recreate four channels of audio from two channels of stereo.

Referring to FIG. 4, a linear matrix as shown therein provides 3 dB of separation, e.g. a soloist mixed equally into the left and right channels, 54, 56 will appear in the front speaker 38 3 dB stronger than in the left or right speakers 54, 56. This corresponds to only 30% or 50% of full separation depending upon whether determined in terms of pressure or power, respectively. Such separation has been found to be inadequate because of the overriding Haas effect, and consequently true decoders in the art were developed to add steering logic to electronically increase volume of the four channels at predetermined times in order to obtain more separation. Such steering logic detected phase effects only in frequencies of a limited bandwidth as, for example, between about 500 to 5K Hz. This detected information in turn was utilized to change the volume of all frequencies equally, having a relatively slow response on the order of tens to hundreds of milliseconds, and typically was not even time-aligned with the signal.

Notwithstanding the relative simplicity of such a system, it was found to be remarkably effective in fooling the human ear into perceiving a surround sound field. It has been found that the ear bases directional sensing on transient peaks whereby, for example, if two people are talking, their voice peaks will occur at differing times and the human "logic" will steer the signal in the direction of the perceived peak. During moments when both voices are of equal amplitude however, the steering logic cannot operate, but the human ear nevertheless does not mind because it could not have distinguished direction very well under such conditions in any event. Accordingly, it "remembers" where each voice was and fills in direction for the hearer.

From the foregoing, due to the properties of the ear, it was found that effectively four channels of sound might be encoded into two channels. It was an object of the invention to seek a way to provide for two channels of sound within effectively one channel.

It was a further object of the invention to provide for encoding of a digital stereo signal to provide digital audio compression in stereo in half the normal bandwidth.

It is yet another object of the invention to create the effect of a stereo system in the bandwidth of a monophonic system plus a very small co-channel.

It was yet another object of the invention to do so such that with small systems in most cases the perceived signal would be indistinguishable from a true stereo signal. These and other objects are met by the present invention, a description of which may be understood with reference to the accompanying figures wherein:

SUMMARY OF THE INVENTION

Left, right, and surround components of a stereo signal are coded into a monaural and small co-channel providing volume steering for recreating a stereo effect with a substantially reduced bit rate. During coding, left and right channels are combined with random phase to avoid directional bias. In one embodiment this is implemented by splitting the signal into sum and difference signals, randomizing the difference signal, and then adding the sum to the randomized difference to comprise the single audio channel. Low frequency boom and high frequency noise are first removed with a band pass filter. During coding, left and right volumes are calculated for the co-channel. Original left and right signals are monitored during intervals corresponding to each sample in the co-channel, with the time range of each monitored interval being selected so that the volume envelope will time align with the audio signal during decoding. For each point of the digital audio signal in that interval, such monitoring builds a sum of the square of the left channel, sum of the square of the right channel, and the sum of the product of the left and right channels. After each interval a functional relationship is solved for left and right steering volumes which is then transmitted for that interval on the co-channel. Decoding of the single transmission channel directs it to left, right, or surround channels based on decoding on the logic co-channel. The co-channel updates left and right volume levels at least twenty times a second which are interpolated through time to effect smooth volume change. Surround gain is determined from left and right channel gains to maintain unity total volume, with the sum of the squares of the three volume controls being unity.

DETAILED DESCRIPTION OF THE PREFERRED EMBODIMENT

Figure 6:
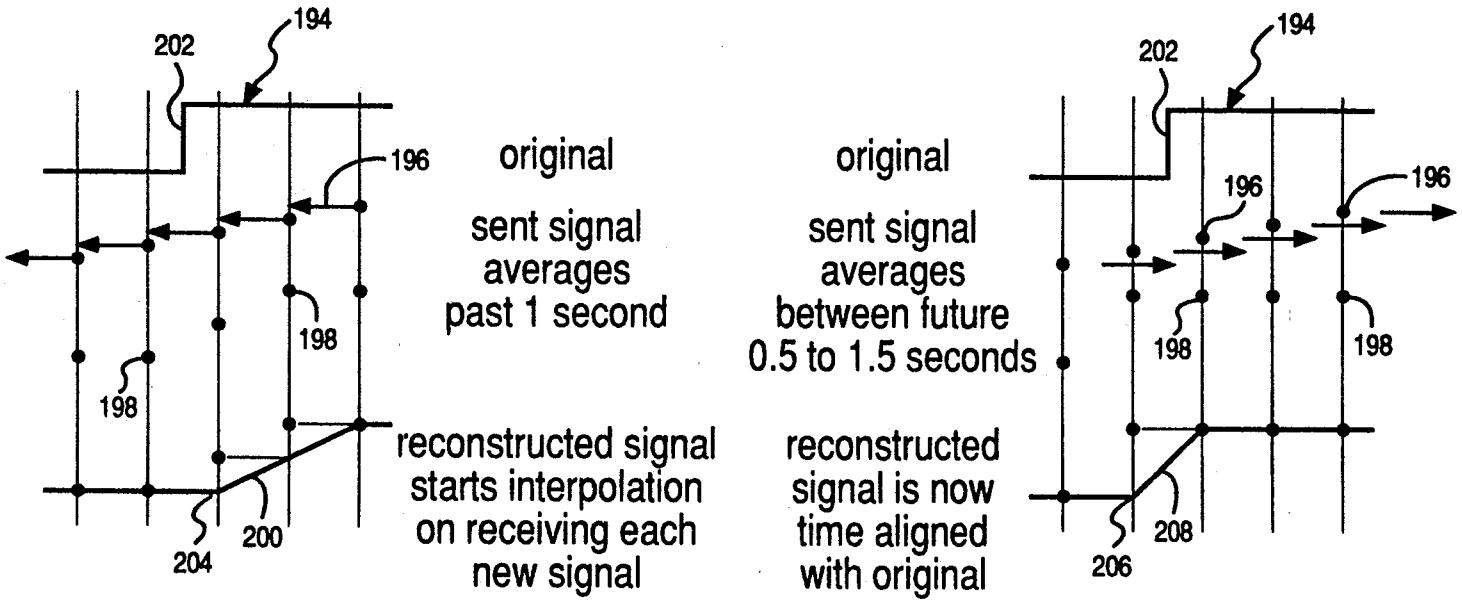
FIG. 6 is an illustration of the range each monitored interval must cover in accordance with the system of FIG. 5 in order to provide for a volume envelope which is time-aligned with the audio signal during decoding.
Figure 5:
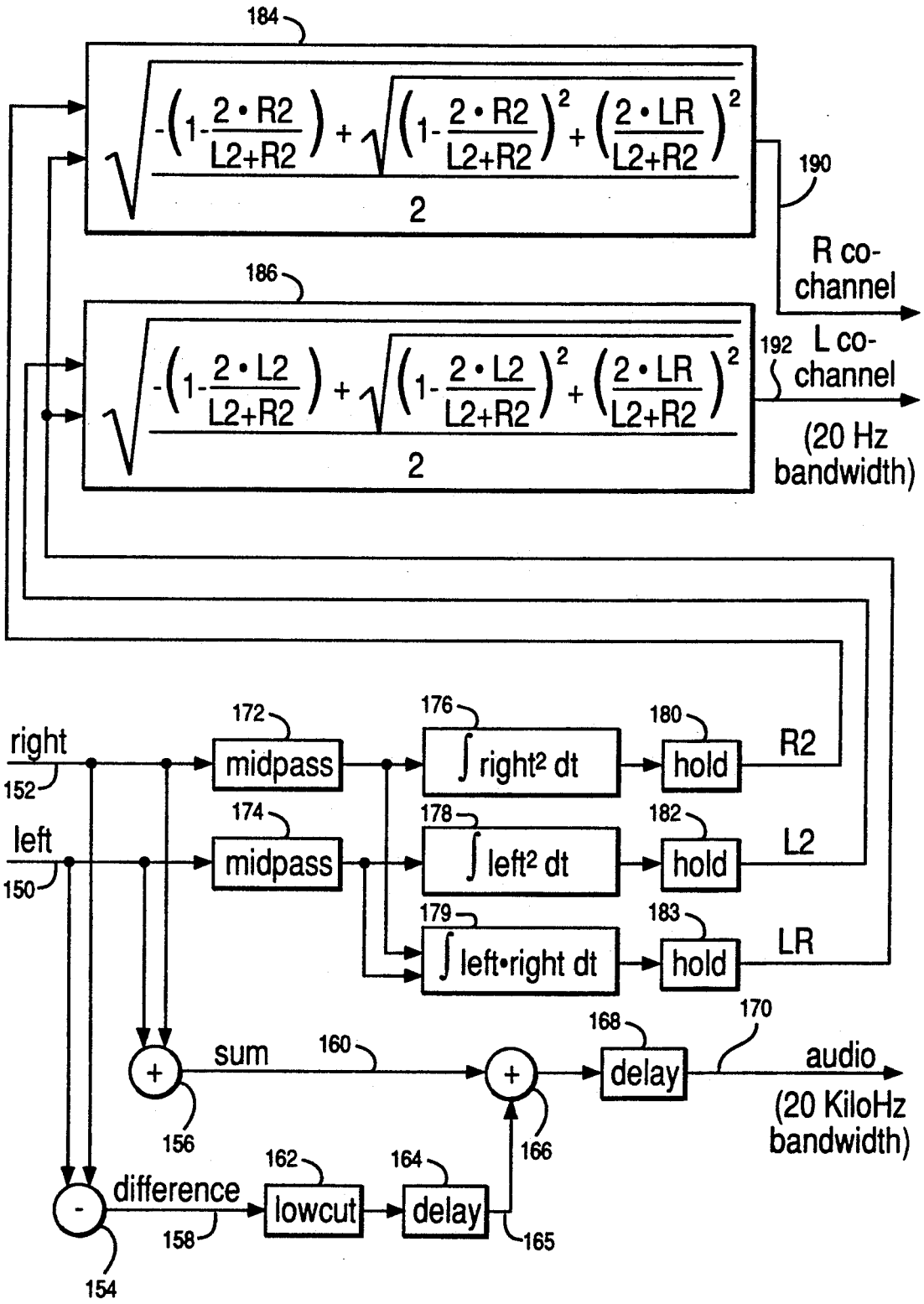
FIG. 5 is an illustration of a system for encoding a stereo signal in the manner of the invention.

Referring first to FIGS. 5 & 6, a detailed description will be provided of the system and method for coding a stereo signal in the manner of the invention. This will be followed with a discussion of FIG. 7 of a correlative system and method for decoding the signal thus encoded so as to achieve the objectives of the invention.

During the discussion it will be apparent that any of the elements may be realized in analog circuitry, in digital circuitry, or effected by a program in a digital computer or DSP. The preferred embodiment converts an analog signal to digital samples using an A/D converter, places these samples in a computer memory, operates on and transmits these samples using well known computer software and hardware techniques, and finally reconverts these samples to analog using a D/A converter.

Figure 1:
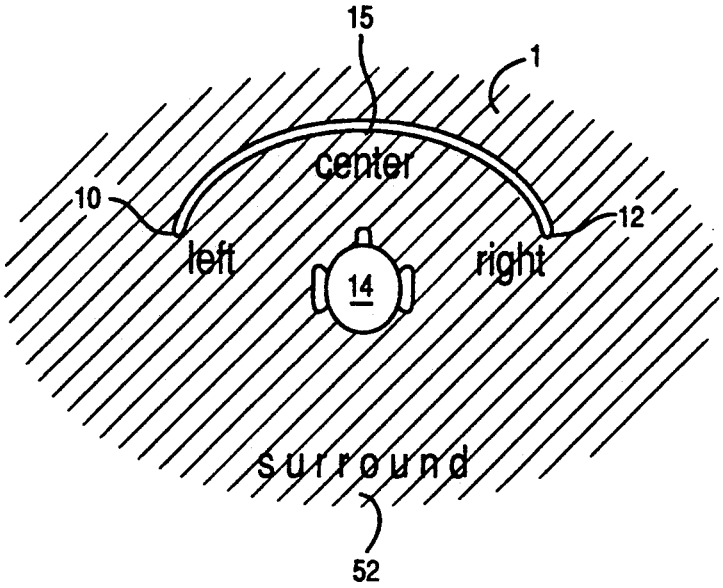
PRIOR ART FIG. 1
FIG. 1 is an illustration of a conventional surround-type stereo field.
Figure 2:
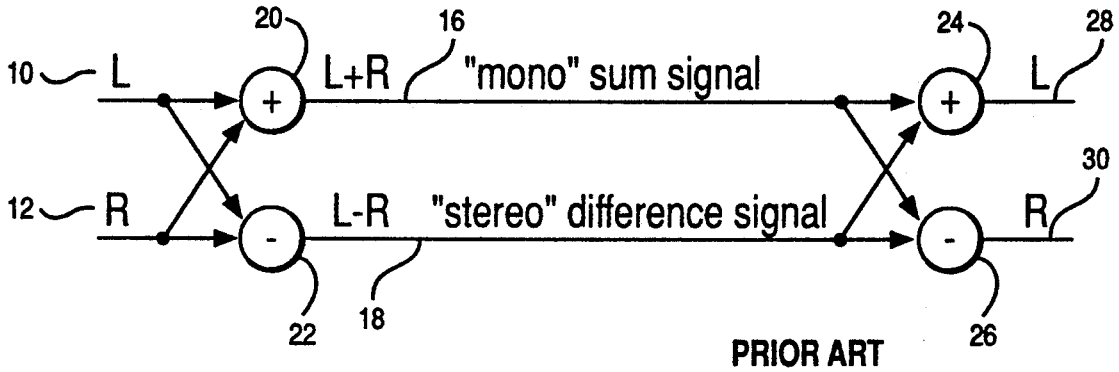
PRIOR ART FIG. 2
FIG. 2 is a schematic illustration of a typical sum and difference type of stereo encoding and decoding scheme of the prior art.
Figure 3:
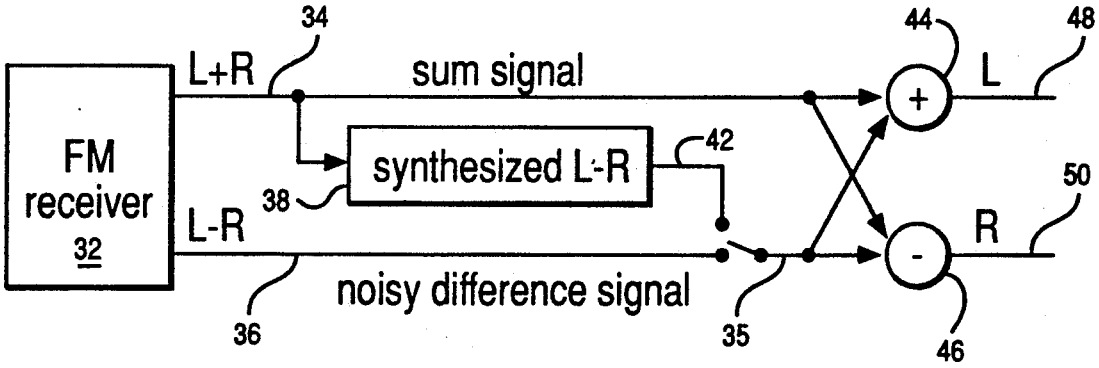
PRIOR ART FIG. 3
FIG. 3 is a schematic illustration of a Carver FM noise reduction stereo encoding and decoding system known in the prior art.
Figure 4:
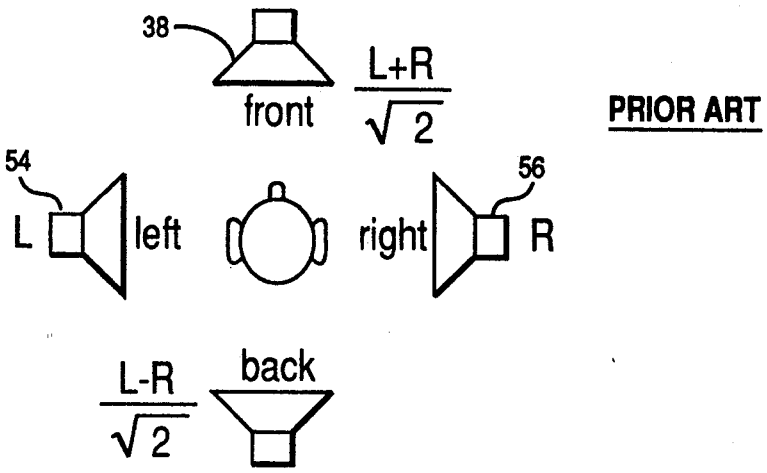
FIG. 4 is an illustration of a conventional means for effecting a surround sound type of stereo field in the manner of FIG. 1 also known in the art.

With respect to coding, first a general discussion will be provided of methodology followed by a more detailed description with reference to FIG. 5 and then FIG. 6. During coding, the original left and right channels of the stereo signal source must be combined with random phase to avoid directional bias. Several methods are available for doing so, one of which is to split the signal into a sum and difference signal in the conventional manner, such as that depicted in FIGS. 2 & 3, but thereafter to randomize the difference signal and then add the sum to the thus-randomized difference signal in order to make the single audio channel. Most simply, this phase randomization can be a simple delay of about 10 msec.

Also during the coding phase, left and right volumes must be calculated for a co-channel. In order to do so, the original source left and right signals must be monitored during intervals corresponding to each sample in the co-channel. For each point of the digital audio signal in such an interval, this monitoring adds to the sum of the square of the left channel, the sum of the square of the right channel, and the sum of the product of the left channel times the right channel. At the end of each such interval, an equation is solved for the left and right volumes which will thence be transmitted for that particular interval on the co-channel, and the sums cleared in preparation for the next interval. This equation is solved in boxes 184 and 186 of FIG. 5. The equation is most simply solved algorithmically using a digital computer, however it may also be solved in analog.

Referring to FIG. 5, the coding process will now be described in more detail. First the coding for determining the left and right volumes for the co-channel will be described. First as previously noted, confusing low frequency boom and high frequency noise are removed from the right and left channels 152 and 150 by appropriate mid-pass filters 172, 174. These filters may be implemented for example as a filter having a single pole high-pass at 800 Hz and double pole low-pass polls at 5 KHz. The right and left channels 152, 150, are monitored at intervals corresponding to each sample in the co-channel. Output of the mid-pass filters 172, 174 are fed to corresponding functional blocks 176, 178, respectively which by squaring, convert the raw signal level to an indicator of signal power, the outputs of these boxes 176, 178 in turn being fed to hold circuits 180 and 182 for the right and left channels, respectively. The product of the square of the left and right channels and integration of the product is further developed by the functional block 179, the output of which, in like manner to blocks 176–178, is stored by the hold circuit 183 before being passed to the function blocks 184 and 186.

These hold circuits provide the sampling interval as noted. Outputs of these hold circuits 180, 182 are then routed to respective right and left volume calculator function boxes 184, 186 which solve for the mathematical relationship therein and output right and left co-channel volume signals 190, 192, respectively.

Also as previously noted, during coding shown in FIG. 5, the original left and right channels must be combined with random phase to avoid directional bias. The right and left signals 152, 150 are accordingly split into sum and difference signals 160, 158, respectively, by feeding the right and left signals into a respective sum function 156 and difference function 154. The difference signal 158 is thence randomized after being fed through a low-pass filter 162 by means of the delay circuit 164 to generate the randomized difference signal 165. This randomized difference signal 165 is then added to the sum signal 160 by the adder function 166. Output of the adder function 166, after being routed through the delay circuit 168, results in the desired single audio channel output 170.

The range of each monitored interval as hereinbefore discussed, must be time-aligned as illustrated in FIG. 6, in order that the volume envelope will be time-aligned with the audio signal during decoding.

Referring more particularly to FIG. 6, an original signal 194 is provided which, or purposes of illustration is a step function as indicated at 202. In a conventional manner a transmitted signal would average the signal 194 over preceding preselected discrete intervals such as 1 second for example as shown graphically by arrows 196, thereby resulting in sample points 198 comprising a sampled sloping waveform. Also in a conventional manner, a reconstructed signal would normally start interpolating on receiving each new transmitted signal such as that shown by the sample 198, thereby resulting in the waveform 200. Because in a conventional manner the interpolation begins on receiving each new signal, the step 202 of the step function 194 may be seen as being delayed 2.204.

Still referring to FIG. 6, and more particularly the right portion thereof, in accordance with the invention, the representation of the original step functional signal 194 is repeated. However, the signal representing this function 194 which is now sent in accordance with the invention will desirably be an average for the following or "future" signal over a preselected interval such as 0.5 to 1.5 seconds after the given time interval, as shown by sample points 196. This ability to average future values of the signal 194 over the preselected interval is made possible by reason of the discrete sampling and holding functions provided by the hold circuitry 180, 182, and 183 in conjunction with a delay of the rest of the signals not going through the hold circuitry 180, 182 and 183. This future averaging results in a transmitted signal comprised of sample points 198 which in like manner to the sample points 198 of the portion of FIG. 6 to the left roughly approximates the step function. A reconstructed signal from the sample points 198 is thereby formed in accordance with the invention resulting in the waveform 208. However, because the transmitted signal averages the "future" sample points of the waveform 194 in accordance with the invention, the reconstructed waveform 208, reconstructed from the sample points 198 may now be seen to be time aligned with the original signal 194, e.g. it will be noted that the step function 206 of the original signal occurs approximately in the middle of the ramp portion 206 of the reconstructed signal 208.

With the foregoing in mind, the details of the mathematical aspects of providing for such coding provided in functional blocks 184, 186 of FIG. 5 will now be disclosed in greater detail.

Let $L$ = left channel gain at decode $R$ = right channel gain at decode $S$ = surround channel gain at decode = $\sqrt{1 - L^2 - R^2}$ so that $L^2 + R^2 + S^2$ = unity.

Then decoded left channel $RMS = M\sqrt{L^2 + \frac{S^2}{2}} = M\sqrt{\frac{1 + L^2 - R^2}{2}}$ decoded right channel $RMS = M\sqrt{R^2 + \frac{S^2}{2}} = M\sqrt{\frac{1 + R^2 - L^2}{2}}$ Where M=single audio channel RMS level and where the surround channel is injected $\sqrt{2}/2$ into the left channel and $\sqrt{2}/2$ into the right channel with random phase, and where (left channel RMS)$^2$+(right channel RMS)$^2$=M$^2$ to give unit power gain. "RMS" stands for Root Mean Square" and is a common term for a power related average. Now let $$L2=\Sigma(\text{left channel})^2$$

$$R2=\Sigma(\text{right channel})^2$$

$$LR=\Sigma(\text{left channel}\cdot\text{right channel})$$

where "left channel" and "right channel" correspond to the actual signal waveforms, and the summation is over a time interval corresponding to the speed of the co-channel. Similar analysis on the decoded signal yields:

$$L2' = \Sigma(\text{decoded left channel})^2 = \frac{1+L^2-R^2}{2}\cdot M^2$$

$$R2' = \Sigma(\text{decoded right channel})^2 = \frac{1+R^2-L^2}{2}\cdot M^2$$

$$LR' = \Sigma(\text{decoded left channel}\cdot\text{decoded right channel}) = L\cdot R\cdot M^2$$

It will be noted that the randomly phased surround commponent multiplied by "S" does not affect this crosscorrelation term "LR'", and hence "LR'" is the product of "L" and "R" scaled by the power of the single audio channel, which is "$M^2$".

| | |
|---|---|
| The equations | $L = f(L2,R2,LR)$ and |
| | $R = f(L2,R2,LR)$ are solved |
| in order to make | $L2' = L2$ |
| and | $R2' = R2$ |
| and | $LR' = LR$ |

so that the original signal levels match each component by the decoded signal levels. The assumption is made that the single audio channel is derived such that $L2+R2=M^2$, in other words, the power in the single channel equals the power in both original channels. Solving these equations yields:

$$L=\sqrt{\frac{-\left(1-\frac{2\cdot L2}{L2+R2}\right)+\sqrt{\left(1-\frac{2\cdot L2}{L2+R2}\right)^2+\left(\frac{2\cdot LR}{L2+R2}\right)^2}}{2}}$$

$$R=\sqrt{\frac{-\left(1-\frac{2\cdot R2}{L2+R2}\right)+\sqrt{\left(1-\frac{2\cdot R2}{L2+R2}\right)^2+\left(\frac{2\cdot LR}{L2+R2}\right)^2}}{2}}$$

If $LR<0$, then the channels are antiphase. Antiphase may be ignored by limiting LR to greater than or equal to 0. To reproduce antiphase, an extra sign bit may be transmitted. On coding, the sign bit will then be set to the sign of LR, LR will then be set equal to $|LR|$, and L and R are calculated using the above formulas. On decode, the sign bit will be applied to either L or R. The sign bit will only change as one of the L or R gains passes through zero, the decoding process may employ this to avoid switching noise by always changing the sign of the particular gain that is passing zero, and only at the instant it is zero. Using this algorithm, the sign of both L and R may be negative, but the double negative will make no difference in the perceived sound.

It will be appreciated that in some instances it may be desirable to provide for even more efficient use of bandwidth by compressing the co-channel, although typically such a co-channel might only require on the order of 160 bits per second.

Figure 7:
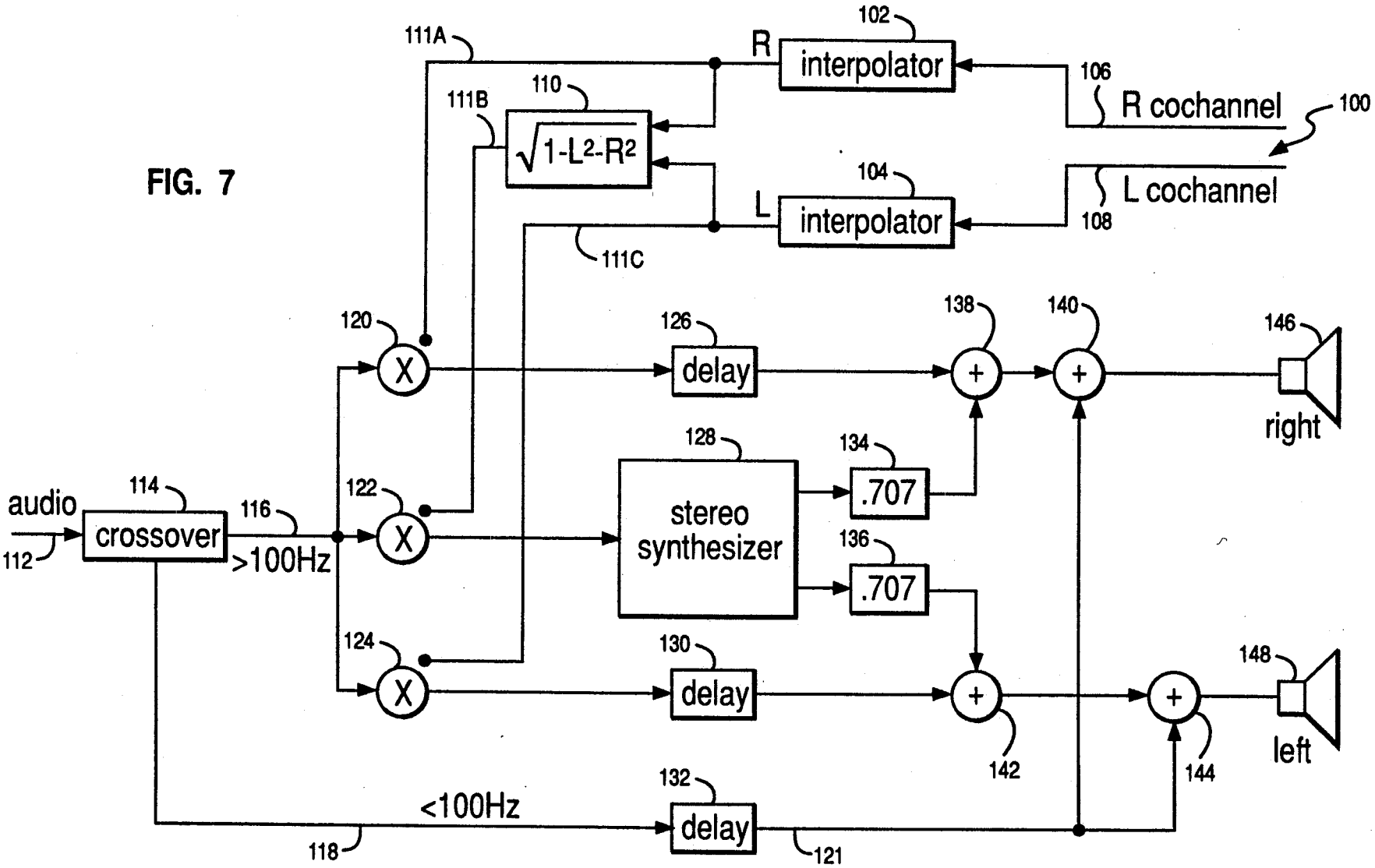
FIG. 7 is an illustration of a system for decoding a stereo signal encoded in the system depicted in FIG. 5.

Turning now to FIG. 7, once the stereo signal has been encoded as hereinbefore described with reference to FIGS. 5 and 6, the uniquely encoded signal may thereafter be decoded in order to achieve the desired stereo effect. It will be recalled from a discussion from the background of the invention that three important components of a stereo signal were identified, namely the left, right, and "surround" signals (with the center being an equal mixture of left and right in a two speaker stereo system). Moreover, the background description also demonstrated that two extra channels could be created by directing volume from one into the other channel during transient peaks. The present invention employs a single transmission channel unlike that of conventional stereo, and directs this channel to either the left, right, or surround channel based on a smaller logic co-channel. As also set forth in the background of the invention, the most important of these three channels is the surround channel, thereby explaining why any earlier efforts employing only left and right direction options would have failed to create "stereo".

Turning now to FIG. 7, decoding in the manner of a preferred embodiment of the invention is shown therein in detail. It will be recalled that the co-channel 100 will preferably update the left and right volume levels at least 20 times a second. The right and left levels 106, 108 of this co-channel information 100 may be interpolated by respective right and left interpolators 102 and 104 through time so that volume will change smoothly. Because the total volume should be unity, the surround gain signals 111A, 111B, and 111C are found from the left and right gains. It will be noted that in adding randomly phased audio signals, $0.707+0.707=1$, so that "subtraction" may be accomplished by means of a lookup table shown implemented functionally by block 110 that finds the square root of the sum $(1-L^2-R^2)$ so that sum of the squares of the three volume controls is unity.

Continuing with FIG. 7, the audio channel 112 is fed to crossover network 114 which splits the signal into a single 116 having frequency components in excess of approximately 100 Hz and a second signal 118 containing components of the audio signal 112 having frequencies below the approximate 100 Hz cutoff. Signal 116 is fed into three multiplier circuits 120, 122, 124, whose respective gains are adjusted by the respective surround gain signals 111A, 111B, and 111C the gain-adjusted outputs of which are in turn routed to a delay circuit 126, stereo synthesizer 128, and delay 130, respectively. Multipliers 134 and 136 reduce the output level of the stereo synthesizer 128 by a factor of 0.707, such reduced outputs which are thence routed to respective adders 138 and 142. These adders 138 and 142 are provided to sum the reduced output from the stereo synthesizer 128 with respective outputs of delays 126 and 130 which, in turn, provide delays to the outputs of respective multipliers 120 and 124. A delay 132 is also provided for delaying the signal 118, resulting in the delayed signal 121. Outputs of the adder functions 138 and 142 are respectively routed to subsequent adder functions 140 and 144, respectively. The delayed signal 121 is also routed to these respective summing functions 140 and 144. Thus, adder 140 adds this delayed signal 121 to the output of the adder 138 resulting in the right channel signal 146. In like manner, the adder 144 adds the output of the adder 142 to the same delayed signal 121, thereby resulting in the left channel signal 148.

Now that a description has been provided of the fundamental operating principles of the invention, alternate embodiments will not be described with reference to FIGS. 8–12. In some applications it may be desirable to provide for improved spatial separation of multiple sounds.

Figure 8:
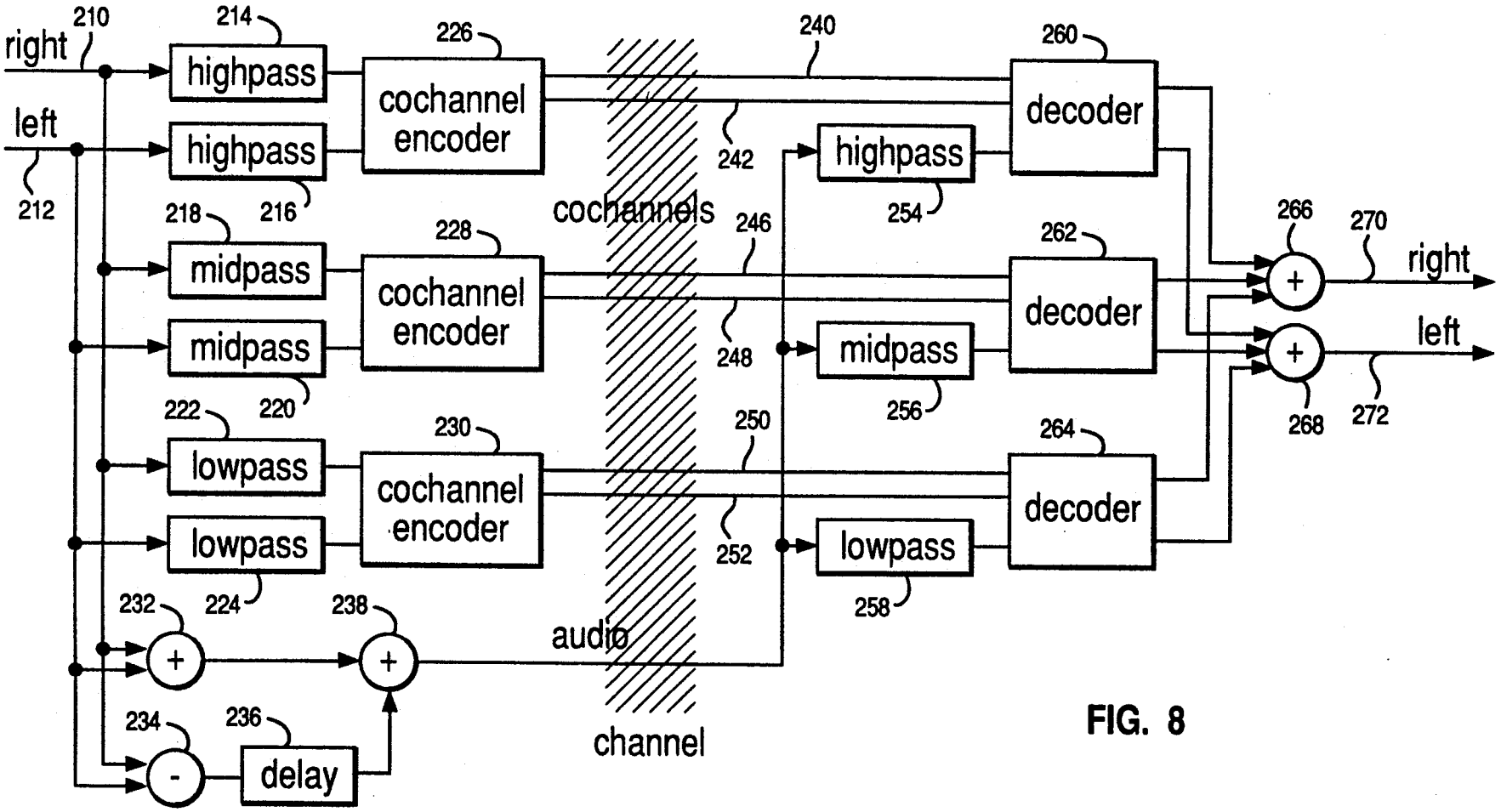
FIG. 8 is an illustration of another embodiment of the invention providing for better spatial separation of multiple frequencies.

Now that a description has been provided of audio compression with co-channel steering in the manner of the invention, a particular embodiment will be described with reference to FIG. 8.

In some applications improved spatial separation of multiple sounds is desired. In such cases it has been found that the source audio signal may be divided into frequency bands, and then the methods hereinbefore described may be applied separately to each band. Thus in FIG. 8, for the right and left channels 210, 212, a corresponding right and left high-pass filter 214, 216, mid-pass filter 218, 220, and low-pass filter 222, 224 are provided which break the signal into three bands. The right and left channels of these three bands are then fed to corresponding band co-channel encoders, 226, 228, and 230, the output pairs 240, 242, 246, 248, and 250, 252 of which are then delivered to their respective band decoders 260, 262, and 264.

The right and left channels 210, 212, are also delivered to a summing function 232 and difference 234 in the manner previously described with reference to the general principles of the invention, wherein the difference signal has random phase introduced by delay 236. The summing function 238 then adds the output of the summing function 232 with the output of the delay 236 and the resulting output is thence delivered to a high-pass, mid-pass and low-pass filter 254, 256, and 258, respectively. Outputs of these filters are then delivered to respective decoders 260, 262, and 264. Finally, a right channel summing function 266 is further provided which sums the right channel outputs of the decoders 260, 264, resulting in a right channel signal 270. In like manner, the left channels of the decoders 260–264 are summed by the left summing function 268 resulting in the left channel signal 272.

Figure 9:
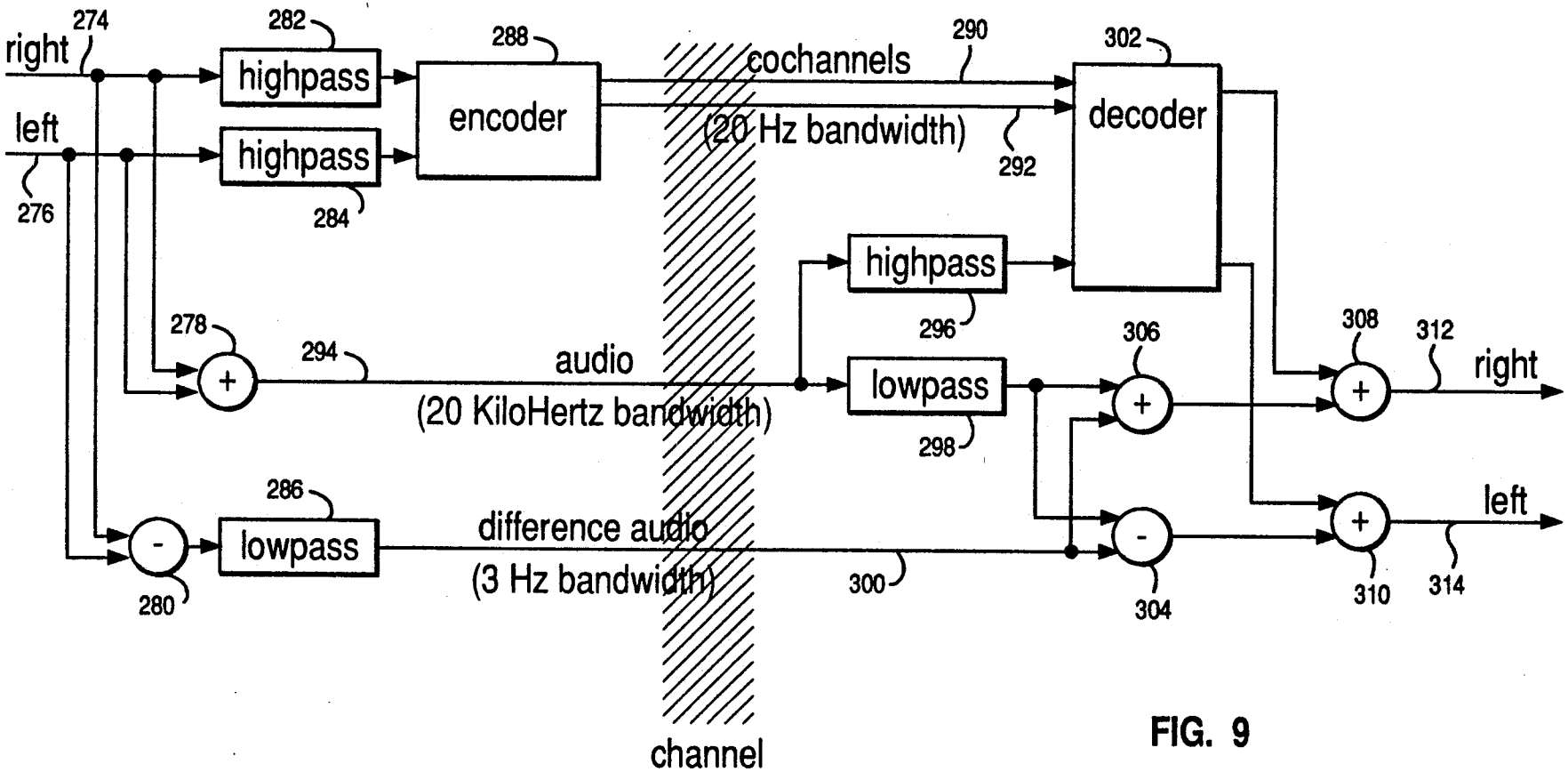
FIG. 9 is another embodiment of the invention providing for true stereo for the fundamentals, and freeing the co-channel to concentrate on articulation of harmonics.

In still another embodiment, with reference to FIG. 9 in some applications it is desirable to provide for true stereo of fundamentals and freeing of the co-channel to concentrate on articulation of harmonics. In such a case, it has been found that the incoming source stereo signal may be divided into a sum and difference signal in the manner previously described. However in such an application the low frequencies of the difference signal will desirably be transmitted, and the high frequencies will be recreated using the co-channel thereby providing for partial synthesis.

Thus in FIG. 9, the right and left channels 274, 276 are sent through respective high-pass filters 282, 284, after which the high frequencies are encoded by the encoder 288, and the resulting high frequency right and left channels 290 and 292 thereafter decoded by the decoder 302 with the right and left outputs being delivered to corresponding summing functions 308, 310. The right and left channel signals 274, 276 are also delivered to a summing function 278 and difference function 280. Output of the difference function after being transmitted through a low-pass filter 286 is then transmitted as a difference audio signal 300, which in a preferred embodiment has approximately a three KHz bandwidth, to a summing function 306 and difference function 304. The output of the summing function 278 is an audio signal 294 which, in this embodiment preferably has a 20 KHz bandwidth, and such output signal 294 is delivered to a high-pass and low-pass filter 296, 298, respectively. Output of the high-pass filter 296 is delivered to the decoder 302 and output of the low-pass filter 298 is delivered to the summing function 306 as well as the difference function 304. The sum of the signals into the summing function 306 is thence delivered to the right channel summing function 308 and added to the output of the decoder 302 resulting in the right channel signal 312. Output of the difference function 304 is delivered to the summing function 310 which sums the signal with the output of the decoder 302 resulting in the left channel signal 314.

Figure 10:
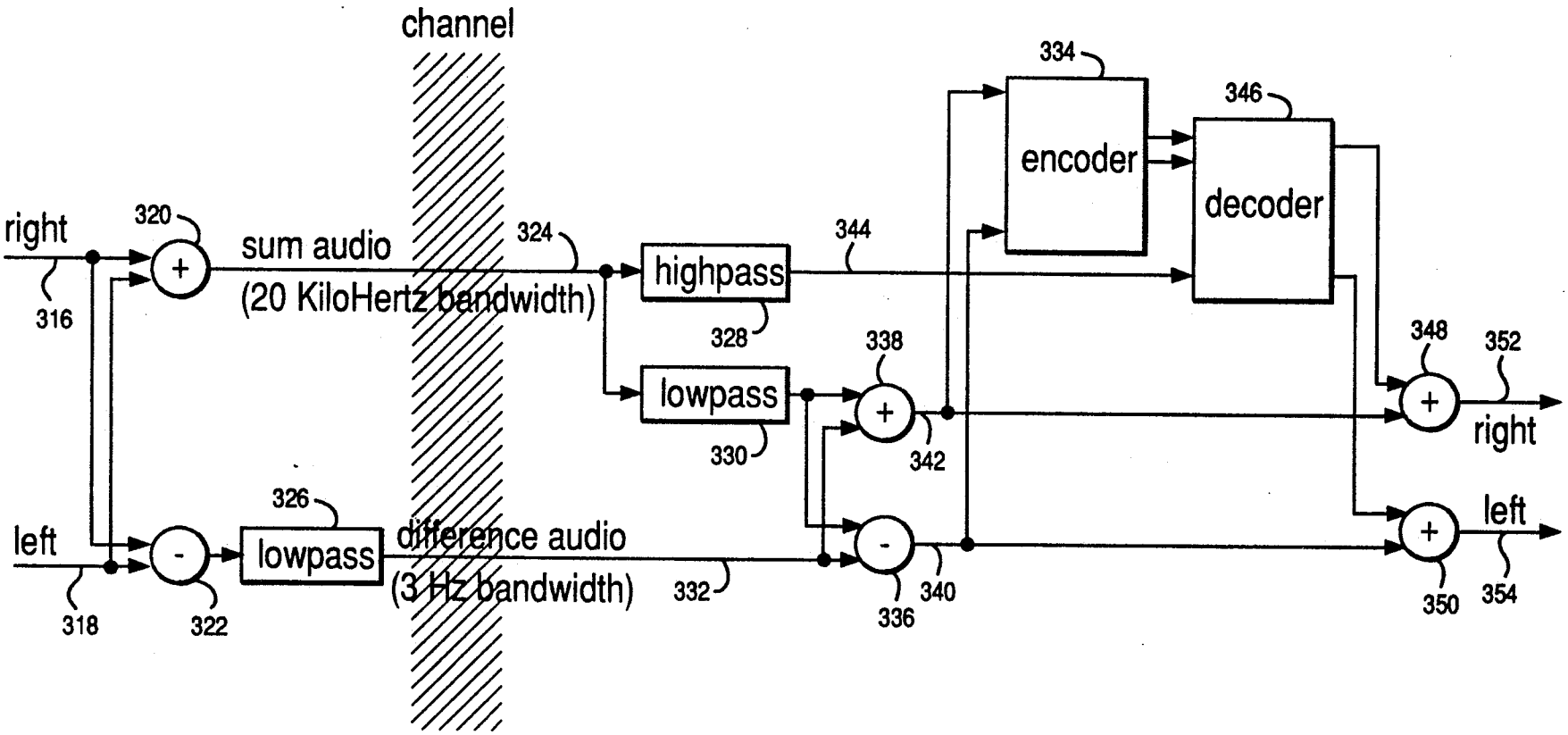
FIG. 10 is yet another embodiment of the invention wherein a co-channel transmission is eliminated.

Referring now to FIG. 10, in still another embodiment it may be desirable to eliminate need for a co-channel. In such instances, it has been found that the stereo signal may first be divided in a conventional manner into the sum and difference signals. Only the low frequencies of the difference will then be transmitted however. Correlations between the sum and difference at low frequencies will thence be utilized to synthesize the high frequencies of the difference from the sum channel, using the same techniques of encoding and decoding taught in this application.

Thus, turning now to FIG. 10, the right and left source signals 316, 318 will be seen to be delivered to the summing and difference functions 320 and 322. With respect to the output of the difference function, it is first transmitted through low-pass filter 326 resulting in the difference audio signal 332, preferably of approximately a 3 KHz bandwidth, this signal then being transmitted to the summing function 338 and difference function 336. This output of the summing function 320 generates a sum audio signal 324, preferably of a 20 KHz bandwidth which is then delivered to a high-pass and low-pass filter 328, 330. Output of the low-pass filter 330 is then delivered to the summing function 338 and difference function 336 which in turn thereby generate the output signals 342 and 340, respectively which are delivered to summing functions 348 and 350. High frequency output signal 344 from the high-pass filter 328 is delivered to the decoder 346. An encoder 334 is further provided with signals respectively from the summing function 338 and difference function 336. Right and left outputs from the decoder 346 generated from the right and left outputs of the encoder 334 and the output 344 of the high-pass filter 328 are delivered respectively to summing functions 348 and 350, the respective outputs of which result in the desired right and left output signals 352, 354.

Figure 11:
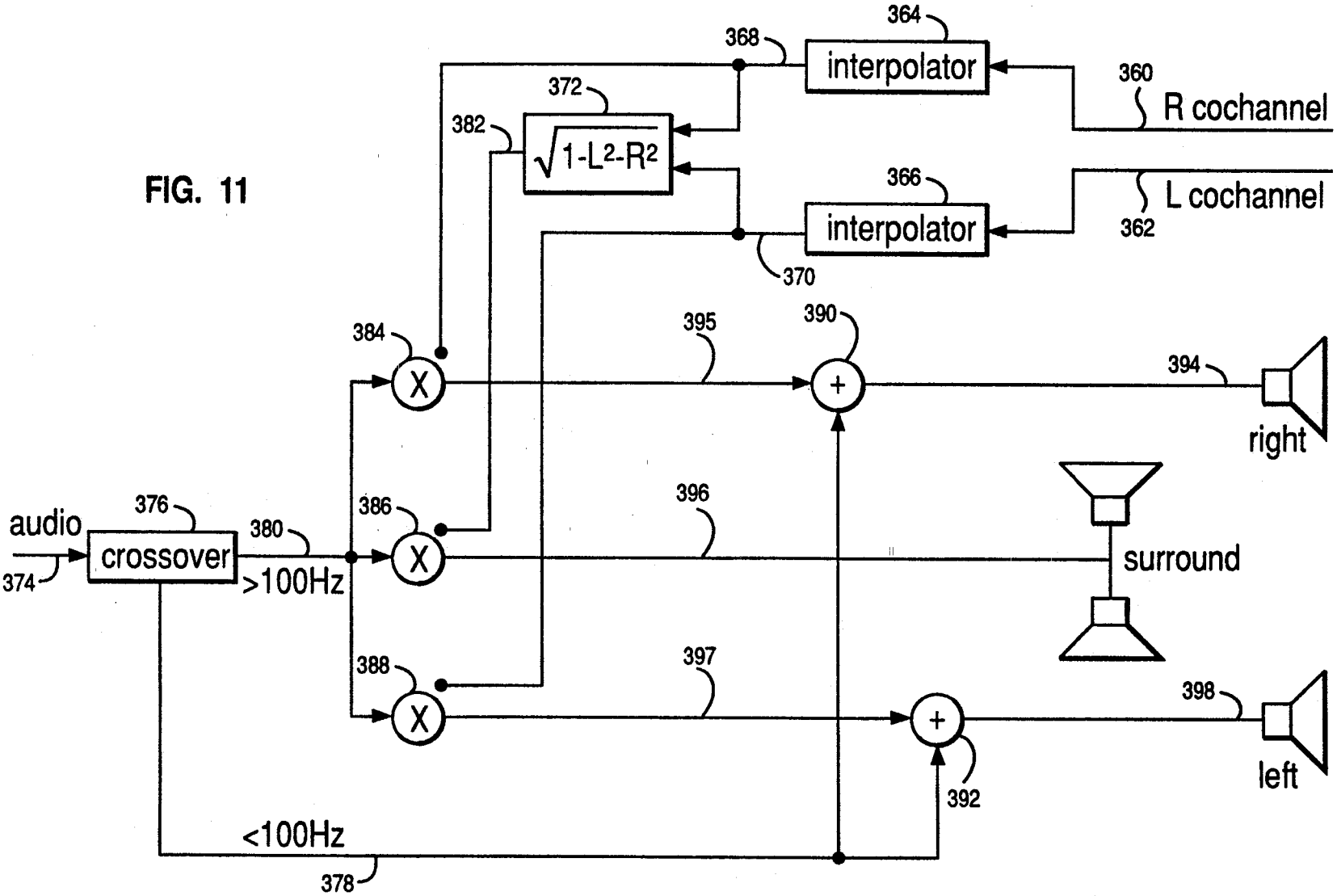
FIG. 11 is another embodiment of the invention providing for outputting the surround channel directly to separate speakers.

Referring now to FIG. 11, in yet another embodiment, it may be desirable to provide for output sounds which may be considered superior to conventional two-speaker stereo by providing for three channels. In accordance with this embodiment, as shown in FIG. 11, rather than mixing the surround channel back in, it may be output directly to separate speakers, thereby providing for three channels.

Specifically, with reference to FIG. 11, the audio signal 374 may be delivered to a crossover 376 which generates signals 380, 378 which are above and below a crossover frequency such as 100 Hz nominally, respectively. The lower frequency signal 378 is thence delivered to summing function 390 and 392. The higher frequency signal 380 is delivered to product functions 384, 386, 388. Right and left co-channels 360, 362, respectively, are delivered to respective interpolators 364, 366, respective outputs 368 and 370 of which are delivered to product function 384 and 388. These outputs 368, 370 from respective interpolators 364, 366 are also delivered to the function 372 which develops an output 382 functionally related to the function depicted in the box 372, e.g. SQR $(1-L^2-R^2)$. This signal 382 out of the function 372 is delivered to the product function 386. Each product function 384, 386, 388 develops a respective product signal 395, 396, 397 corresponding to the products of each product function's input signals. The product signal 395 is then delivered to the summing function 390 wherein it is summed with the output 378 from the crossover 376 resulting in the right channel output signal 394. In like manner, the product signal 397 from the product function 388 is delivered to the summing function 392 which is also summed with the output 378 of the crossover 376 resulting in the left channel output signal 398. Finally, the product signal 396 comprises the surround signal which may be delivered to appropriate speakers to develop the desired surround sound.

Figure 12:
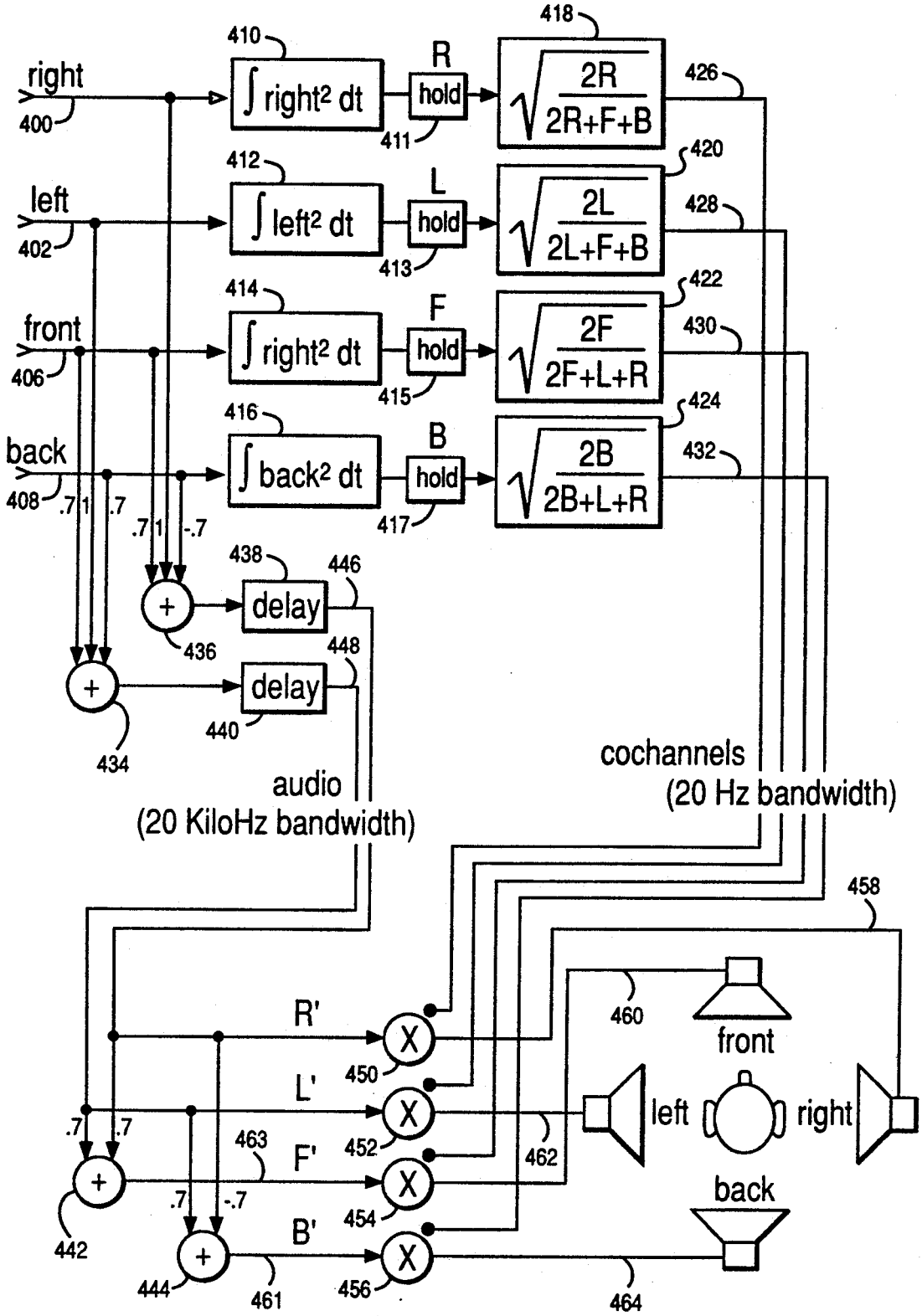
FIG. 12 is still another embodiment of the invention providing for polychannel or multiple surround speaker sound and an immersion sensation.

Finally with reference to FIG. 12, in yet another embodiment a polychannel sound may be desired. In this application, if two channels are transmitted, co-channels may then be employed to mix them as a sum or difference into multiple surround speakers in order to provide the perception of immersion in the sound field provided by polychannel sound.

Accordingly, with reference to FIG. 12, right, left, front, and back input signals 400, 402, 406, and 408 are provided, each of which are routed through respective function boxes 410–416 and 418–424 to provide resulting right, left, front and back signals 426, 428, 430 and 432 which are in turn routed to respective product functions 450–456. Each output of the function boxes 410–416 will be appropriately delayed by respective hold functions 411, 413, 415, and 417, similar to those shown in FIG. 5, 180–183, before being operated upon by functions 418–424. These hold circuits provide sampling intervals as noted previously. The left, front, and back signals 402, 406, and 408 are routed to summing function 434 which applies coefficients 0.7, 1, and 0.7, respectively to these signals and sums them, the sum of which is delivered to delay function 440. In like manner, the right, front, and back signals 400, 406, and 408 are delivered to the summing function 436 which applies coefficients 0.7, 1, and 0.7 to these respective signals, the output of which is delivered to its corresponding delay function 438. The output signals 446 and 448 from respective delay functions 438 and 440 are then delivered to summing functions 442 which applies a 0.7 coefficient to them, the resulting sum of which is delivered as the front signal to the product function 454. In similar manner these delay output signals 446 and 448 are delivered to the summing function 444 which provides a 0.7 and 0.7 coefficients to these signals and sums them, the output of which is delivered to the product function 456. These same output signals 446, 448, are also delivered to product functions 450 and 452. Each of these product functions 450, 452, 454, and 456 develops a respective product function output signal 458, 462, 460, and 464 which are the product of their respective input pairs 446–426, 448–428, 463–430, and 461–432. These outputs of the product functions may be recognized as the front signal 460, left and right signals 462 and 458, respectively, and back signal 464. It will be further noted that the outputs of the functions 418–424 will be recognized as four co-channels with, in a preferred embodiment, each with a nominal 20 Hz bandwidth. The outputs 446 and 448 in like manner will be recognized as the audio channels preferably each with a nominal 20 KHz bandwidth.

I claim:

1. A method for encoding multiple channels of audio information comprising generating at least one encoded channel numbering less than said multiple channels from said multiple channels; and generating a co-channel of volume steering information for each of said multiple channels from said multiple channels comprised of at least one first co-channel and at least one second co-channel;

wherein each of said multiple channels comprises at least one first channel and at least one second channel;

wherein the ratio of said first and second co-channels varies in relation to the ratio of the magnitude of said first and second channels; and said magnitude of said first and second co-channels varies in relation to the correlation of said first and second channels.

2. The method of claim 1 wherein the number of said multiple channels is four and the number of said at least one encoded channels is two.

3. The method of claim 1 wherein the number of said multiple channels is two and the number of said at least one encoded channels is one.

4. The method of claim 3 wherein said two multiple channels comprise a first and a second channel of audio information; and said at least one encoded co-channel is a function of magnitude of said first channel of audio information;

magnitude of said second channel of audio information; and magnitude of a correlation between said first and said second channels of audio information.

5. The method of claim 4 wherein the frequency of said first and second channels of audio information is limited to preselected ranges.

6. The method of claim 1 further including executing a summing process of said multiple channels and wherein said at least one encoded channel is generated from said summing process of said multiple channels.

7. The method of claim 1 wherein the phase of said multiple channels is randomized in said summing process.

8. The method of claim 7 wherein said randomizing of said phase comprises the steps of deriving first and second signals comprising the sum and difference of said multiple channels, respectively;

delaying said second signal to produce a third signal; and summing said third with said first signal.

9. The method of claim 1 wherein frequency of said multiple channels is limited to preselected ranges.

10. The method of claim 1 wherein said at least one co-channel is derived substantially only from high frequency components of said multiple channels.

11. The method of claim 1 wherein said at least one co-channel is derived from information in the low frequency component of said multiple channels; and said at least one encoded channel is generated from the high frequency components of said multiple channels.

12. The method of claim 1 wherein said at least one encoded channel is functionally related to the magnitudes of said co-channel.

13. The method of claim 10 wherein said high frequency component is above about 1 kilohertz.

14. Apparatus for encoding multiple channels of audio information comprising means for generating at least one encoded channel numbering less than said multiple channels from said multiple channels; and means for generating a co-channel of volume steering information for each of said multiple channels from said multiple channels comprised of means for generating at least one first co-channel and at least one second co-channel;

wherein of each said multiple channels comprises means for at least one first channel and at least one second channel;

wherein the ratio of said first and second co-channels varies in relation to the ratio of the magnitude of said first and second channels; and said magnitude of said first and second co-channels varies in relation to the correlation of said first and second channels.

15. The apparatus of claim 14 wherein the number of said multiple channels is four and the number of said at least one encoded channels is two.

16. The apparatus of claim 14 wherein the number of said multiple channels is two and the number of said at least one encoded channels is one.

17. The apparatus of claim 16 wherein said two multiple channels comprise a first and a second channel; and said at least one encoded co-channel is a function of magnitude of said first channel;

magnitude of said second channel; and magnitude of a correlation between said first and said second channels.

18. The apparatus of claim 17 wherein the frequency of said first and second channels is limited to preselected ranges.

19. The apparatus of claim 14 including summing means for generating said at least one channel encoded from a summing process of said multiple channels.

20. The apparatus of claim 19 including randomizing means for randomizing the phase of said multiple channels in said summing process.

21. The apparatus of claim 20 wherein said randomizing means includes means for deriving first and second signals comprising the sum and difference of said multiple channels, respectively;

means for delaying one of said first or second signals to produce a third signal; and means for summing said third with the remaining one of said first or second signals.

22. The apparatus of claim 14 wherein frequency of said multiple channels is limited to preselected ranges.

23. The apparatus of claim 14 wherein said at least one co-channel is derived substantially only from high frequency components of said multiple channels.

24. The apparatus of claim 14 wherein said at least one co-channel is derived from information in the low frequency component of said multiple channels; and said at least one encoded channel is generated from the high frequency components of said multiple channels.

25. The apparatus of claim 23 wherein said high frequency component is above about 1 kilohertz.

* * * * *